United States Patent [19]

Marlow et al.

[11] Patent Number: 4,869,152

[45] Date of Patent: Sep. 26, 1989

[54] COMBINED ACTIVE AND PASSIVE ARMOR SYSTEM

[75] Inventors: Peter G. Marlow, Harrogate; Melvyn Perry, Wetherby; Donald Jepson, Leeds, all of England

[73] Assignee: Royal Ordnance plc, London, England

[21] Appl. No.: 130,287

[22] Filed: Dec. 8, 1987

[51] Int. Cl.[4] ..... F41H 5/04

[52] U.S. Cl. ..... 89/36.17; 89/36.02

[58] Field of Search ..... 89/36.17, 36.09, 36.02; 109/36, 37

[56] References Cited

U.S. PATENT DOCUMENTS

| | | | |
|---|---|---|---|
| 3,592,148 | 7/1971 | Manis | 89/36.17 |
| 4,051,763 | 10/1977 | Thomanek | 89/36.17 |
| 4,167,889 | 9/1979 | Bohne et al. | 89/36.02 |
| 4,738,184 | 4/1988 | Bohne et al. | 89/36.02 |

FOREIGN PATENT DOCUMENTS

| | | | |
|---|---|---|---|
| 2031658 | of 0000 | Fed. Rep. of Germany | 109/37 |
| 1902856 | 9/1969 | Fed. Rep. of Germany | 89/36.17 |
| 2031658 | 5/1972 | Fed. Rep. of Germany | 109/37 |
| 2053345 | 2/1977 | Fed. Rep. of Germany | 89/36.17 |
| 2636595 | 2/1978 | Fed. Rep. of Germany | 89/36.17 |
| 2821281 | 11/1978 | Fed. Rep. of Germany | 109/37 |
| 355773 | 2/1930 | United Kingdom | 109/37 |

*Primary Examiner*—Deborah L. Kyle
*Assistant Examiner*—Stephen Johnson
*Attorney, Agent, or Firm*—Stevens, Davis, Miller & Mosher

[57] ABSTRACT

A composite armor system comprises a homogeneous metal armor plate and a plurality of reactive armor panels, each said panel comprising a forward layer, an intermediate layer of explosive material and a rearward layer, the homogeneous armor plate being formed with a plurality of recesses in its forward surface and the rearward layer of each reactive armor panel being received in a respective one of said recesses.

7 Claims, 1 Drawing Sheet

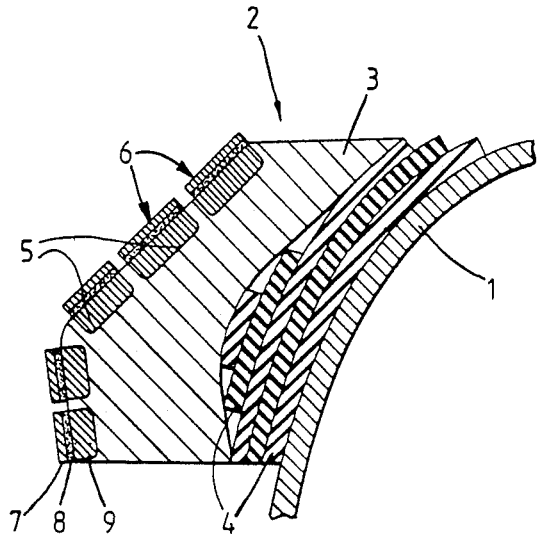
2
3
6
5
1
7
8
9
4

COMBINED ACTIVE AND PASSIVE ARMOR SYSTEM

This invention concerns an armour system which incorporates armour of two different types in such a way as to provide an effective defence against differing threats posed by various highly effective weapons which are available today. The armour system provided by the invention thus includes active and passive elements combined in such a way that the strengths of the two types complement one another.

In modern warfare an armoured fighting vehicle or other armoured installation requires adequate defence against extremely powerful attacks from both kinetic energy weapons such as long-rod, and chemical energy weapons such as the shaped charge or squash head explosive devices. All of these weapons have different penetration mechanisms, and thus different forms of armour are required for their effective defeat.

The traditional form of armour is of course in the form of a homogeneous metal plate such as armour steel or lighter aluminium alloys developed for use as armour plate. These may be several inches thick, and their effectiveness depends upon their thickness. Although such armour plate can theoretically defeat any form of attack provided the plate is thick enough, in practice the thickness is limited by considerations of cost, and more significantly perhaps in the case of an armoured fighting vehicle by considerations of weight. Mobility is an important aspect of performance which is impaired by excessive weight.

In order to provide greater effectiveness against certain weapons, it has been proposed to employ reactive armour consisting of a layer of metal backed by a layer of explosive material. The explosive is detonated by the attack and the metal layer is thus projected into or across the path of the attacking device so as to destroy or degrade its attack mechanism. Reactive armour can provide increased effectiveness on a weight for weight basis against some attacking weapons, but can be difficult to fix to the surface of the installation or vehicle to be protected, and especially to do so whilst ensuring that a single hit does not detonate the whole area of reactive armour.

The present invention seeks to provide an armour system in which the benefits of homogeneous armour and reactive armour are combined in such a way that the strengths of the two armour types complement each other, the fixing of the reactive armour is facilitated, and the detonation of the explosive component of the reactive armour is confined to a zone close to the point of attack.

According to the invention there is thus provided a composite armour system comprising a homogeneous metal armour plate and a plurality of reactive armour panels, each said panel comprising a forward layer, an intermediate layer of explosive material and a rearward layer, the homogeneous armour plate being formed with a plurality of recesses in its forward surface and the rearward layer of each reactive armour panel being received in a respective one of said recesses.

The forward and rearward layers of the reactive armour panels may comprise metal, e.g. steel, plate although they could also be made of any of the composite structural materials well known to those skilled in the art.

Most conveniently the homogeneous armour plate is formed with the recesses by casting.

In a preferred arrangement of the armour system, the homogeneous armour plate is provided with at least one backing layer of a resilient material, such as rubber.

In the latter case, armour system can advantageously be attached to the surface of the installation to be protected, e.g. a vehicle hull, by means of the resilient material. The resilient material provides, in a known way, resistance against metal spalling caused by the projectile striking the homogeneous armour plate.

A Brief Description of the Drawing is as follows:

The invention will now be described by way of example only with reference to the accompanying drawing, which is a diagrammatic sectional plan view of a portion of a vehicle hull protected by an appliqué armour system in accordance with the invention.

As shown in the drawing, a vehicle hull 1 is protected by an armour system in accordance with the invention. Only a single section 2 of the armour system is shown in the drawing, but in practice the whole area of the hull to be protected is covered with abutting sections of similar construction.

The section 2 comprises a plate 3 of homogeneous armour formed by casting, for example from armour steel, or aluminium alloy. The plate 3 is shaped so as to conform approximately to the contour of that part of the hull 1 to which the section 2 is fitted. Interposed between the hull and the plate 3 are five layers 4 of rubber or other resilient material. These are cut as shown so as substantially to fill the space between the hull 1 and the plate 3, and may be vulcanised one to another as well as to the hull 1 and the plate 3.

Rectangular recesses 5 are cast into the outer surface of the plate 3, and fitted into each recess 5 is a panel 6 of reactive armour. Each panel 6 comprises an outer layer 7 of metal such as rolled homogeneous armour, an intermediate layer 8 of explosive material, and a rearward layer 9 which can be of metal or preferably of a shock-attenuating material. The rearward layer 9 is a close fit into the corresponding recess 5, leaving the explosive layer 8 and the outer layer 7 proud of the surface of the plate 3. The layer 9 can be fixed in the recess by adhesive.

The edges of the explosive layer 8 are thus surrounded by air, so that the shock of detonation of one explosive layer 8 is attenuated and does not detonate adjacent explosive layers. This attenuation may be more effective if the rearward layers 9 are of shock-attenuating material.

The panels 6 may be mounted in the manner described in a copending application of even date by the present applicants.

The armour system 2 is advantageously mounted so as to be inclined at a substantial angle to the vertical.

In use when an attacking high energy projectile strikes the outer surface of a panel 5, a shock is transmitted through the metal layer 7 to detonate the explosive layer 8 of that panel. The spacing between the panels is small so that any projectile sufficiently large to pose a threat will strike at least one panel 6. The metal layer 7 is thus driven forward so as to disrupt and degrade the concentration of energy in the attacking projectile. By virtue of the attenuating structure just described, the explosion of layers 8 is confined to the area under attack.

The much dissipated projectile next encounters the thick homogeneous armour plate 3, which is thus penetrated only by the most powerful attack. In case of a sufficiently powerful weapon, fragments of penetrator may pass right through the plate 3, or fragments of spall may be ejected from the rear face of the plate 3. Such fragments may possess sufficient energy to do significant damage. However, the layers 4 of resilient material, especially when sandwiched between the plate 3 and the hull 1 are particularly effective in dissipating any such residual energy of attack.

It can thus be seen that the invention provides a particularly effective armour system, for use against both kinetic energy and chemical energy weapons, and in which the strengths of the component armour types complement each other. Furthermore, the detonation of reactive armour panels is confined to the area which comes under direct attack, and panels which have been detonated are easily and quickly replaceable.

We claim:

1. A composite armour system comprising a homogeneous metal armour plate and a plurality of reactive armour panels, each of said panels comprising a forward layer, an intermediate layer of explosive material and a rearward layer, the homogeneous armour plate being formed with a plurality of recesses in its forward surface, the rearward layer of each reactive armour panel being received in a respective one of said recesses and the intermediate layer of each reactive armour panel standing outside of a respective one of said recesses.

2. A composite armour system according to claim 1 wherein the homogeneous armour plate is formed with the recesses by casting.

3. A composite armour system according to claim 1 wherein the homogeneous armour plate is provided with at least one backing layer of a resilient material.

4. A composite armour system according to claim 3 wherein the resilient material is rubber.

5. A composite armour system according to claim 3 wherein the resilient material is bonded to a rear face of the homogeneous metal armour plate.

6. An armored vehicle having a hull and a composite armour system according to claim 5 wherein the resilient material is also bonded to said hull so that the armour system is attached to said hull by means of the resilient material.

7. An armored vehicle having a hull to which a plurality of abutting armour sections is attached, each of said sections constituting a composite armour system in accordance with claim 1.

* * * * *